United States Patent [19]

Landis

[11] Patent Number: 4,759,465

[45] Date of Patent: Jul. 26, 1988

[54] TEAR STRIP CLOSURE FOR A CONTAINER WITH A SECURITY RING

[75] Inventor: H. Richard Landis, Oak Lawn, Ill.

[73] Assignee: Landis Plastics, Inc., Chicago Ridge, Ill.

[21] Appl. No.: 92,480

[22] Filed: Sep. 3, 1987

Related U.S. Application Data

[63] Continuation-in-part of Ser. No. 927,337, Nov. 5, 1986.

[51] Int. Cl.[4] ..... B65D 17/40

[52] U.S. Cl. ..... 220/276; 220/270; 215/256

[58] Field of Search ..... 220/270, 276, 306; 215/256

[56] References Cited

U.S. PATENT DOCUMENTS

| | | | |
|---|---|---|---|
| 4,190,175 | 2/1980 | Allen | 220/270 |
| 4,660,735 | 4/1987 | Peschardt et al. | 220/276 |
| 4,669,630 | 1/1987 | Kenyon | 220/276 |
| 4,682,706 | 7/1987 | De Vore et al. | 220/276 |
| 4,691,834 | 9/1987 | Bullock, III | 220/270 |
| 4,711,364 | 12/1987 | Letica | 220/270 |

*Primary Examiner*—George T. Hall

*Attorney, Agent, or Firm*—Fitch, Even, Tabin & Flannery

[57] ABSTRACT

A one piece plastic closure is provided for a container having a retention bead. The enclosure includes a top panel with a skirt interlocked with the retention bead. A removable tear strip on the skirt includes a pull tab to facilitate the grasping thereof. A lift tab, connected to the upper portion of the skirt, facilitates removal of the closure after the tear strip has been torn away from the enclosure to remove its interlocking with the retention bead. A frangible bridge interconnects the pull tab and the lift tab and pulls the lift tab into a more accessible position as the tear strip is removed.

9 Claims, 7 Drawing Sheets

TEAR STRIP CLOSURE FOR A CONTAINER WITH A SECURITY RING

BACKGROUND OF THE INVENTION

This application is a continuation-in-part application of application Ser. No. 927,337 filed Nov. 5, 1986.

This invention relates to a plastic closure which is made inexpensively with injection molding equipment, and more particularly, to such a closure which has a tamper-evident band or tear-off strip which is removed the first time the closure is open to provide a tamper-evident feature for the container and closure and which has a lift-off tab for ease in removing the closure after removal of the tear-off strip.

The present invention is particularly useful with a container which has a security or saturn ring or ledge on the container side wall projecting outwardly of the container side wall at a location immediately below the skirt of the closure to limit access to the lower edge of a tear strip. Because the container security ring projects radially outwardly from the wall of the container and has a larger outer diameter than that of the closure skirt, it is relatively difficult to obtain direct access to the tear-off strip and to remove the closure unless a lift tab remains after removal of the tear-off strip. Also, the security ring protects the strip against accidentally being caught or torn during handling and shipping of the assembled closure and container. More specifically with removal of the tear-off strip, the now lower edge of the remaining skirt is at the location spaced above but still close to the security ring. If one inserts a fingernail under the lower edge of the remaining skirt, the nail hits the container bead and makes removal of the closure difficult. Thus, when a security ring is located slightly below this lower edge of the skirt, it is almost impossible to insert a fingernail under the lower edge of the skirt and to remove the closure with a simple lifting motion. The present invention provides a lifting tab which is accessible after removal of the tear-off strip and which is plainly visible and apparent to the customer that the tab is to be used to lift off the closure.

In one form of the invention illustrated in FIG. 7 of U.S. application Ser. No. 927,337, the lift-off tab is formed by grasping an end of a pull tab and breaking a first bridge or connection between the pull tab and the skirt and pulling the pull tab to cause a second bridge to become effective to pull a first end of the lift tab outwardly from the skirt wall. The skirt wall tears at the thin cross section of the groove and pivots outwardly to form an outer lift tab portion, and the skirt wall stops tearing at a thicker portion of the tab on the lower part of the skirt. A continued pull of the pulling tab removes all of the tear-off strip. While the aforementioned closure works generally satisfactorily, there have been times when the frangible bridge did not break and separate from the lift tab such that continued pulling on the lift tab by the unbroken bridge proceeded to tear the lift tab from the skirt wall during the removal of the detachable tamper-evident band. This undesired removal of the lift tab resulted in a closure that will not be readily accepted by purchasers. Techniques were tried to widen or thicken the cross sectional thickness of the lift tab but these did not cure the problem of an occasional pull tab separating the entire lift tab from the skirt wall. Thus, there was a need to provide a more foolproof manner of assuring that the pull tab consistently separates from the lift tab and leaves the lift tab connected to the skirt wall after removal of the tear strip.

The present invention uses a fracturable bridge between the pull strip and the lift tab to pull the lift tab radially outwardly so that it is very visible and accessible particularly where the closure has a security ring. Preferably, the fracturable bridge pivots the lift tab outwardly about a vertical hinge axis with the skirt wall prior to the bridge fracturing.

The closure and container of the present invention are inexpensively molded in one piece at high speeds and at a relatively low cost. Likewise, the container may be a one-piece molded container of plastic made at high speeds and at low cost. Thus, the invention is directed to a commercially feasible closure and container which can be used for a wide variety of products can be manufactured easily and at high rates to provide an inexpensive closure and/or container.

Accordingly, a general object of the present invention is to provide a new and improved closure with a new and improved pull tab and lift tab which separate from each other consistently when the pull tab is pulled to form the lift tab.

These and other objects and advantages of the invention will become apparent from the following description taken in connection with the accompanying drawings in which

DETAILED DESCRIPTION OF THE DRAWINGS

DETAILED DESCRIPTION 0F THE PREFERRED EMBODIMENT

Figure 9:
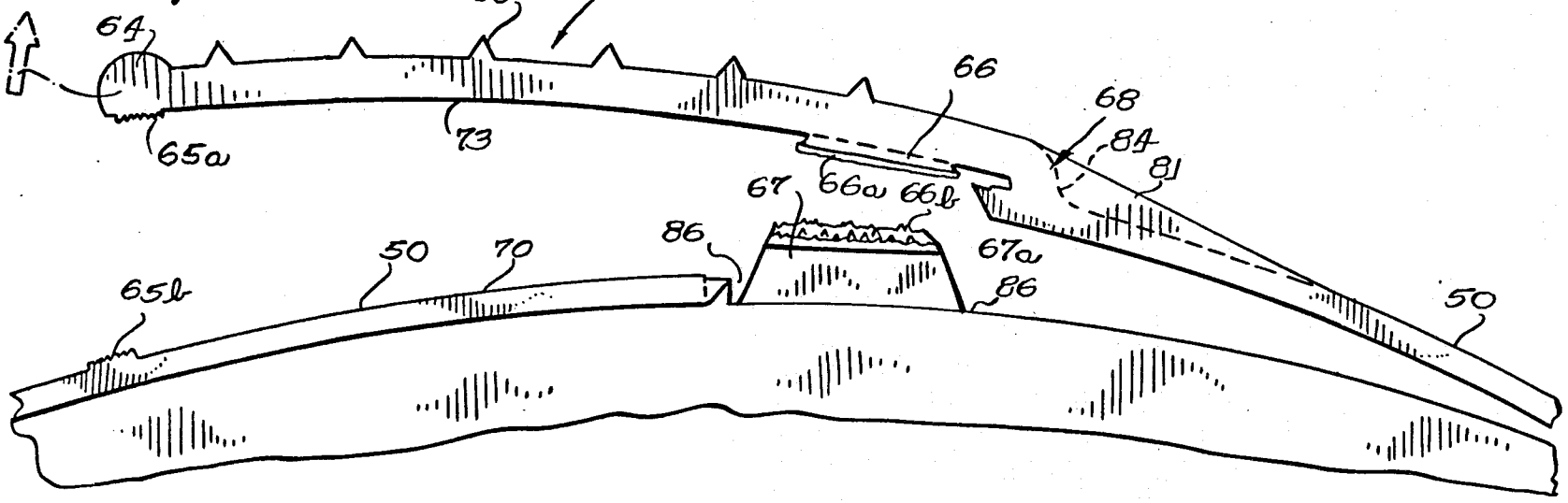
FIG. 9 is a view similar to FIG. 8 with the pull tab detached.
Figure 10:
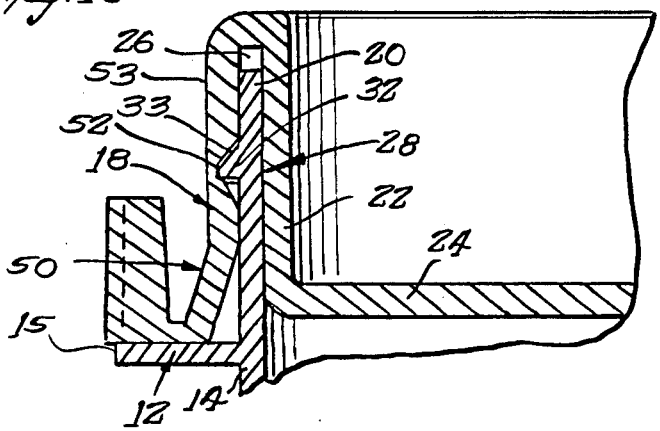
FIG. 10 is an enlarged cross-sectional view taken substantially along the line 10—10 of FIG. 8.

As shown in the drawings for purposes of illustration, the invention is embodied in a container 10 having a closure 11 which is press-fitted and snap-fitted on the container, and in sealing engagement to cover the open mouth of the container. The illustrated and preferred container 10 is formed with an integral security ring 12, sometimes called a "Saturn" ring which is an integral projecting ring or flange which projects radially outwardly from a cylindrical wall 14 (FIG. 10) of the container. The security ring extends generally horizontally from its inner edge which is connected to an inner container wall 14 to an outer peripheral circular edge 15. The closure 11 has a skirt wall 18 which projects downwardly and encircles the rim 20 of the container, as best seen in FIGS. 4A and 10. As illustrated, the rim 20 of the container wall 14 projects upwardly into a generally inverted "U" shaped portion of the closure defined between the skirt 18 and an inverted depending inner leg or wall 22 of the closure. The leg 22 extends downwardly and is integral with a top circular panel 24. The skirt 18 and the inner leg 22 are spaced from each other as shown by the space or gap 26 in FIGS. 9–12. The space 26 is narrower than the distance between the skirt 18 and inner leg 22 such that the closure is frictionally retained on the container when the rim is forced between the skirt and the inner leg.

Additionally, there is a snap-fit interlocking engagement provided between the container and the closure to more positively secure the closure to the container until a tamper-proof band 50 is removed and this comprises an interlocking means 28 between the closure and container. Herein, the preferred and illustrated interlocking means 28 (FIG. 10) comprises an integral outwardly projecting bead 32 on the container which has an upper, inclined surface 33, which slopes downwardly, for example, at 45° which will cam against the skirt wall as will be described in greater detail hereinafter until a recess or groove 36 (FIG. 12) on the skirt 18 is aligned and has received the bead 32, therein. The container rim and bead 32 have been broken away in FIG. 12 to provide a better view of the groove 36. At such time, a lower shoulder 38 on the skirt at the recess 36 abuts a lower generally horizontally extending, lower shoulder 39 on the bead 32 to prevent upward lifting movement of the closure from the container. As readily seen in FIGS. 10–13, a lower edge 40 of the skirt 18 is disposed immediately above and may be in engagement with a top surface 42 of the security ring 12 when the closure is interlocked with the bead on the container.

The security ring 12 will most likely be used in instances where, e.g., where the closure is very flexible, and there is concern that someone could remove the closure by pushing up on the lower edge 40 of the tamper-evident band and push the closure upwardly from the container without tearing off the tamper-evident band 50. In other instances, the person buying the containers may not desire a security ring 12 and rely on the snap-fit engagement of closure to container to hold the closure against someone trying to push against the lower edge 40 of the tamper-evident band 50 and to push the closure off without first removing the tamper-evident band. The present invention is directed to containers with or without the security ring 12 and to alleviating the problem of removal of the closure, after the tamper-evident band has been removed leaving a lower edge **40*a* of the skirt 18 (FIGS. 6 and 7) located adjacent the container bead 50 such that a fingernail inserted below this skirt edge 40*a* hits the container bead 32** thereby making it difficult to lift the closure from the container without the use of a lift tab.

To provide evidence of tampering, it is preferred to provide the tear-off or tamper indicating band or strip 50 along a lower portion 51 of the skirt 18 which detaches along the line of weakness 52, which is a thin web 89, from the upper portion 53 of the skirt 18. The line of weakness 52 may be at any place brt herein it is located at the thinnest cross section in the skirt and formed at a wall 54 (FIG. 12), which is at the outer, bottom portion of the recess 36. When a user pulls radially outwardly on the tear strip 50, the tear strip readily tears through the thin web 89 located at the bottom wall 54 and separates at this line of weakness 52 in a well-known manner leaving a new, lower edge **40*a* for the skirt 18**.

The preferred tear strip 50 has a pull-off tab 60 which the user will grasp and pull on to remove the tear strip 50.

Figure 6:
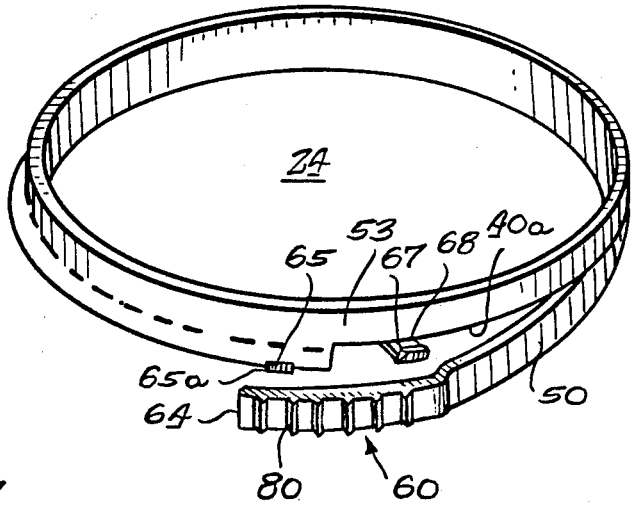
FIG. 6 is a perspective view similar to FIG. 5 but with the pull tab and tear strip partially removed.
Figure 7:
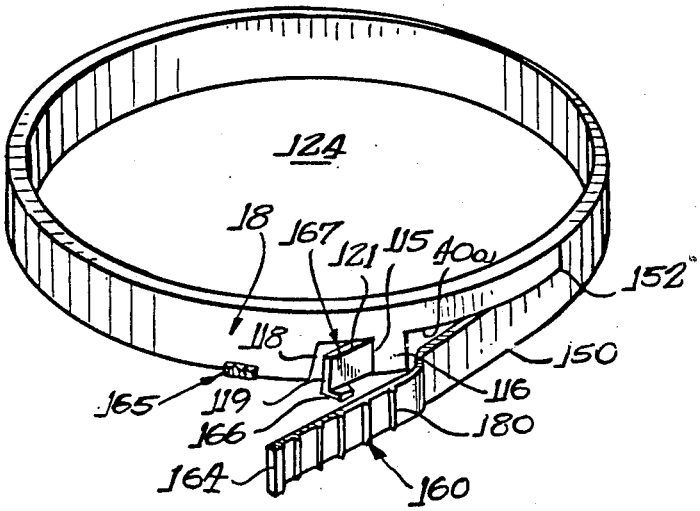
FIG. 7 is a view similar to FIG. 6 but of another embodiment of the invention.
Figure 8:
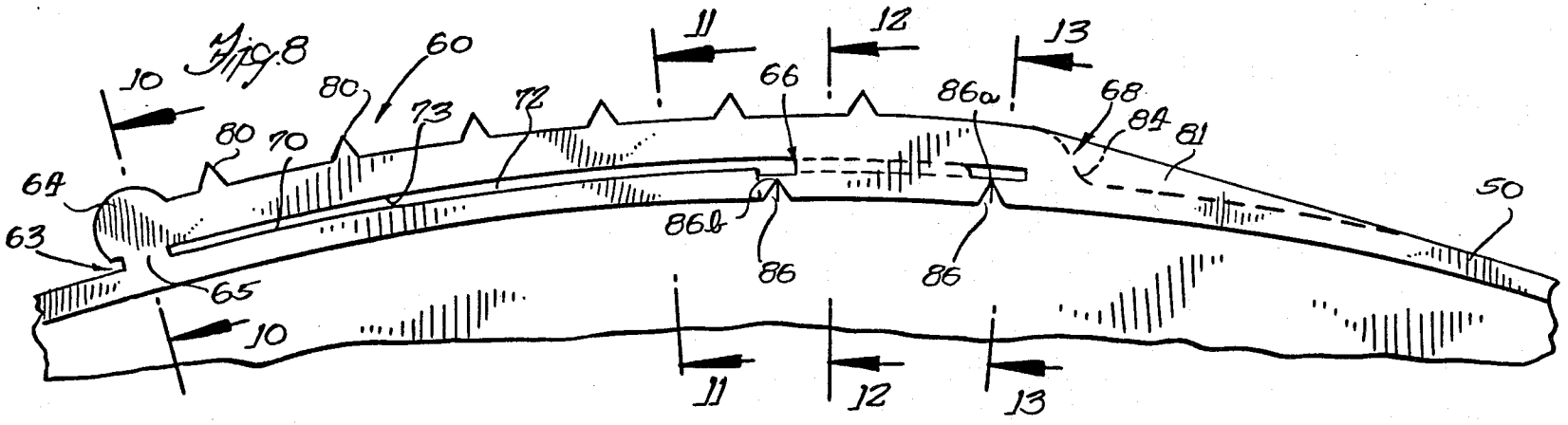
FIG. 8 is an enlarged fragmentary view of the pull tab prior to its detachment.

In accordance with the present invention, there is provided a new and improved one-piece closure having a pull tab 60 to tear off the tear strip 50 and which exposes and makes accessible a lift tab 67 for grasping by the user to lift the closure upwardly from the container. In the preferred embodiment of the invention, the lift-off tab 67 is initially hidden behind the pull tab 60 and is pulled outwardly to be exposed and accessible after the pull tab is grasped and pulled by the user. Herein, the user will insert a fingernail, or tool, into a slot 63, as best seen in FIG. 8 and will pry outwardly on an enlarged knob or free end 64 of the pull tab to break a frangible bridge 65 (FIG. 7) and then proceed to break a second frangible bridge 66 which is located more closely adjacent a hinge portion 68 which hinges the pull tab to the tear strip. As best seen in FIGS. 6, 7 and 9, the bridge 66 breaks and tears from the pull tab leaving a large lift portion or lift tab 67 for lifting the closure from the container. As the pull tab swings radially outwardly as shown in FIGS. 6, 7 and 9, it pulls the lift tab radially outwardly and also upwardly so that the lift tab remains spaced above the security ring 12 and projecting outwardly of the skirt for easy noticeability and ease of grasping by the person desiring to lift-off the closure and to have access to the contents of the container.

Figure 5:
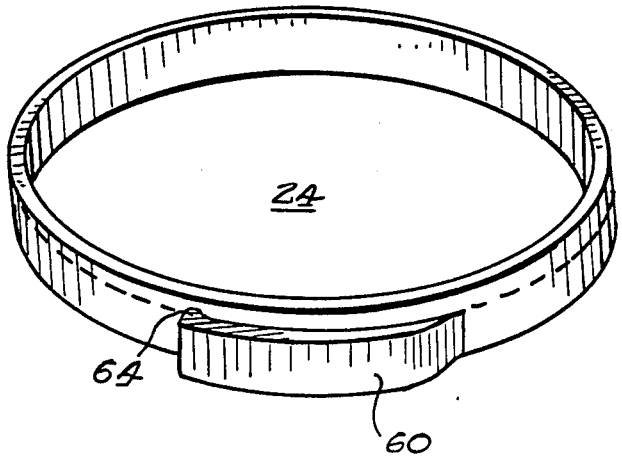
FIG. 5 is a perspective view of the closure having a tear strip and a pull tab constructed in accordance with one embodiment of the invention.

Recapitulating, the pull tab 60 generally covers and hides the lift tab as seen in FIG. 5, and as the pull tab is pulled outwardly it breaks the bridge 65, as seen in FIG. 6 and also breaks the bridge 66; and, during the pulling of the bridge 66 to its breaking point, the bridge pulls the lift tab upwardly and outwardly to insure its exposure or visibility. As best seen in FIGS. 6 and 7, the lift tab 67 is integrally connected at a hinge line or portion to the bottom of the skirt wall **40*a* this hinge line at the web 89 at the bead recess 36 in the skirt. The lift tab 67 shown in FIGS. 6, 7 and 12 includes a tip or portion 66*b* which was part of the bridge 66 and longer body 67*a*** which was disposed downwardly in alignment with tamper-evident band 50.

The first frangible bridge 65 is preferably located on the lower edge of the removable tear strip 50 and extends radially outwardly therefrom to an inner vertical wall 70 on the pull tab 60, as best seen in FIG. 8. The frangible bridge 65 usually tears with a small portion 65*a*remaining on the pull tab 60 (FIG. 9) and a small portion 65*b* of the bridge 65 remains on the tear strip 50. The bridges 65 and 66 span a slot 72 (FIG. 8) located between the inner vertical wall 70 of the tear strip and a facing vertical wall 73 of the pull tab. The slot 72 is a thin narrow space extending arcuately, as best seen in FIG. 7, between the bridges 65 and 66. Thus, the pull tab is spaced outwardly of the tear strip 50 by the bridges 65 and 66 and the hinge portion 68.

The illustrated pull tab 60 is preferably provided with some outer vertical ribs or corrugations 80 along its outer surface. The ribs 80 provide a better gripping surface to prevent sliding of the fingers off of the tab. Herein, it is preferred to provide additional strength at the hinge 68 by including an integral horizontal flange portion 81 (FIGS. 8 and 9) extending between the pull tab 60 and the tear strip 50 at the lower edge thereof. The preferred hinge is generally bowed with a generally arcuately shape section 84 adjacent the second bridge 66 which spaces the attached end of the tab radially outwardly from the lower portion of the skirt 18 and causes formation of the slot 72. The preferred second bridge 66 preferably breaks into small portion 66*a* which remains attached to the pull tab 60, as best seen in FIG. 8, and with a much larger portion 66*b* which forms an end of the lift tab 67 and is attached to the body 67*a* of the lift tab 67.

The lift tab 67 of FIGS. 8 and 9 is integrally attached to the tear strip 50 and in alignment therewith and is formed when the tear strip band is separated therefrom at V-shaped notches 86 when the tear strip is removed. More specifically, as shown in FIG. 9, the initial separation of the pull tab 60 and the initial tearing of tear strip along the line of weakness 52 also results in the fracturing a small web 86*a* (FIG. 8) at the bottom of the notch 86. The web 86*a* had joined the right side of the lift tab body 67*a* to adjacent portion of the tear strip 50. The removal of the tear strip is completed when the tear strip is pulled along the line of weakness 52 to the left hand notch 86 at which is a small fracturable web 86*b* of plastic joining the tear strip to the left side of the lift tab 67.

Figure 11:
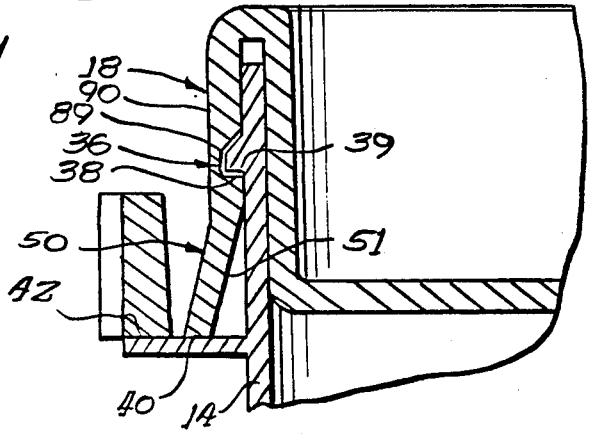
FIG. 11 is an enlarged cross-sectional view taken along the line 11—11 of FIG. 8.
Figure 12:
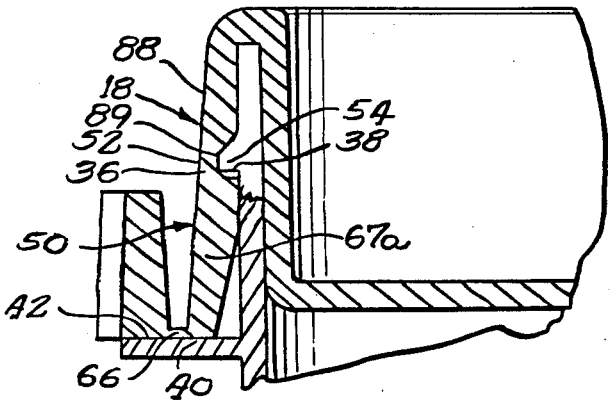
FIG. 12 is cross sectional view taken substantially along the line of 12—12 of FIG. 8.
Figure 13:
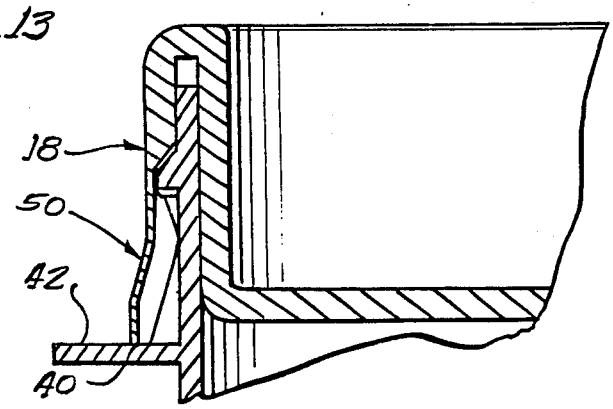
FIG. 13 is an enlarged cross-sectional view taken substantially along the line 13—13 of FIG. 8.

In order to insure further that the pulling of the tear strip 50 doesn't cause a fracturing of the lift tab 67 at the location of the bead receiving groove 36 therein, it is preferred to increase the cross-sectional thickness of the lift tab. As best seen in FIG. 12, the outer side of the lift tab has been formed to come straight downwardly along a surface 88 resulting a thicker web 89 of plastic between the bottom wall 54 of the recess and the outer surface 88. In contrast thereto, the web 89 between the bottom wall 54 and outer surface 90 is much thinner as shown in FIG. 11 which shows a cross section located not at the lift tab. The surface 90 extends substantially more vertically than inclined surface 88. This increased thickness at the web 89 for the lift tab also provides a thicker hinge web 89 so that the lift tab will not break when a strong lift force is being applied thereto. By way of example, the web 89 in FIG. 11 may be about 0.005 inch thick and the web 89 in FIG. 12 may be about twice as thick.

Figure 1:
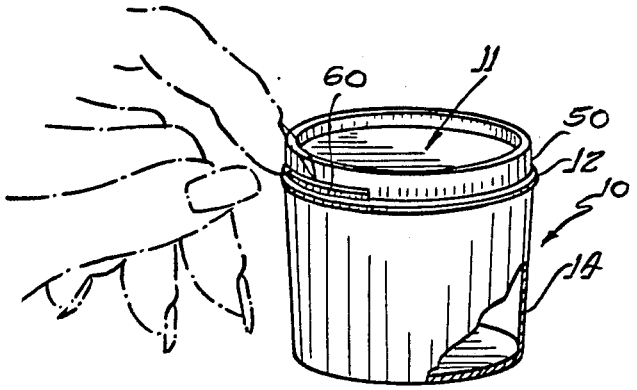
FIG. 1 is a perspective view of a container and closure constructed in accordance with one embodiment of the invention.
Figure 2:
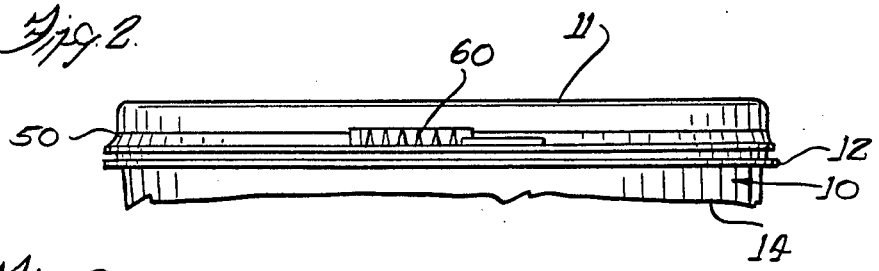
FIG. 2 is an enlarged fragmentary side elevational view of the closure and the top marginal portion of the container.
Figure 3:
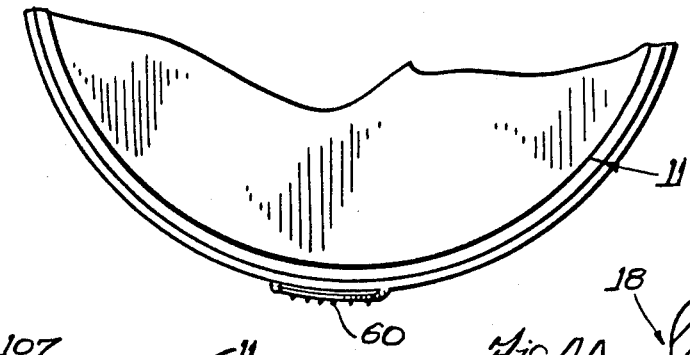
FIG. 3 is a plan view of the closure shown in FIG. 2.
Figure 4:
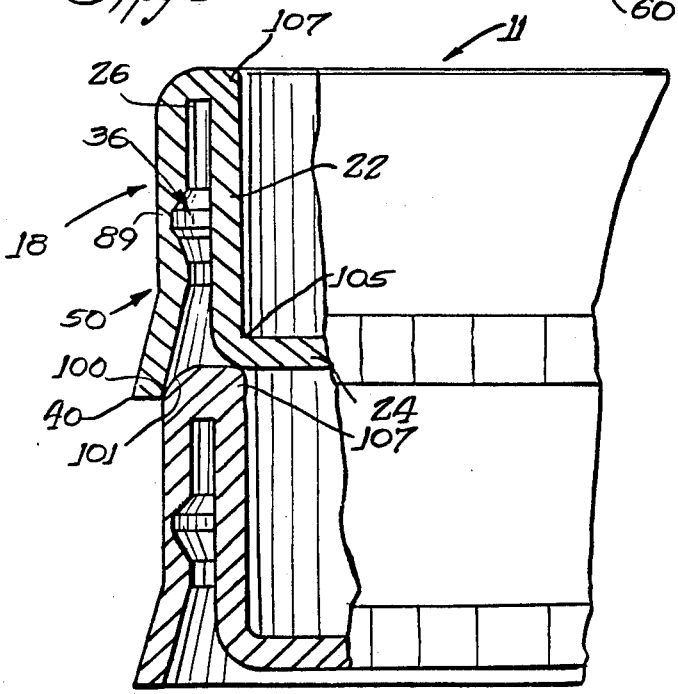
FIG. 4 is a fragmentary view showing the stacking of closures of the invention.
Figure 4A:
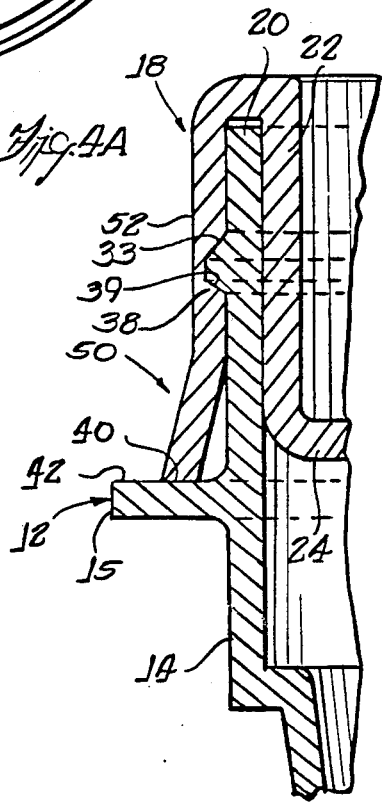
FIG. 4A is an enlarged cross sectional fragmentary view of closure interlocked to a container rim.

The illustrated closures may be readily stacked, as shown in FIG. 4, for automatic feeding and delivering to a capping device which merely pushes the closure down onto the container rim to snap the recess over the container bead to interlock the closure to the container. As best seen in FIG. 4, a lower and inner edge or corner 100 of the skirt 18 abuts and rests on an upper, rounded corner 101 of the closure next below in the stack. A lower corner 105 formed between the inner leg 22 and the central panel 24 rests on the upper circular corner 107 which joins the skirt leg to the inner annular leg 22.

In a further embodiment of the invention illustrated in FIG. 7, a prefix "1" has been added to designate previously described elements as best seen in FIG. 7, a pull tab 160 is detached by pulling the end 164 to break a first bridge 165 for connecting the pull tab to the lower end of the skirt. The pull tab 160 is pulled to remove the tamper-evident band 150 and to form the lift tab 167. More specifically, a frangible second bridge 166 extends between the lift tab 167 and the pull tab 160. The lift tab is hinged along a vertical hinge line 115 to a portion 116 located inwardly of the pull tab. Notches similar to the notches 86 previously described are formed to provide frangible, thin webs which break to form trailing edge 118 of the tear-off strip 150 and to form an adjacent vertical side edge 119 for the lift tab. The web 89 located at the bottom wall of the recess may be made thinner at the location of the lift tab so as fracture and leave a top end wall 121 on the lift tab. Because the bridge 166 is stronger than the webs at locations of the tab edges 119 and 121, a pull on the pull tab 160 breaks these webs and forms the lift tab. The portion 116 may be thickened in cross section so that the web 89 is thicker at the portion 116 and therefor will not tear. Thus, a continued pull on the pull tab forms the lift tab and then fractures second bridge 166 before tearing away at the line of weakness 152 at the thin web at the bottom of the groove in the skirt wall to allow removal of the tear strip. The lift tab is hingedly connected at hinge line 115, which defines a vertical hinge axis, to the portion 116 and projects outwardly therefrom to be noticed by user who will know to grasp and lift the closure by the lift-off tab.

Figure 14:
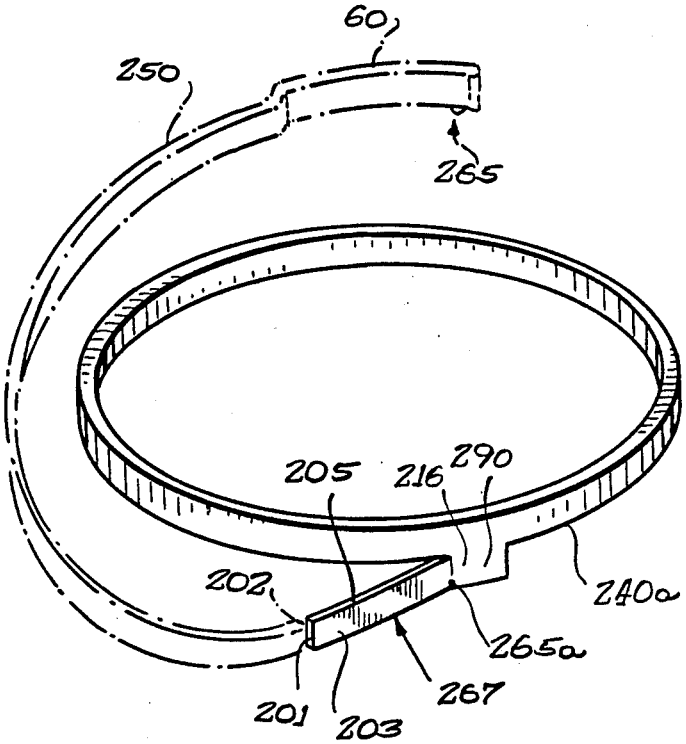
FIG. 14 illustrates a closure constructed in accordance with a still further embodiment of the invention.

In accordance with a still further embodiment of the invention, as illustrated in FIG. 14, the lift tab is formed at the end of the tear strip during its removal from the closure. More specifically, the tear strip (which is shown in phantom) has a pull tab 260 connected by a bridge 265 which tears and leaves a piece 265*a*. Continued tearing the tear strip 250 from the closure forms the lift tab 267. A notched web 201 formed between and end 202 for the tear strip and an adjacent vertical outer end 203 of the lift tab. The web 201 is thicker and stronger than the web 89 at the bottom of the bead groove at the area of the lift tab so that the web 89 first fractures to form top edge 205 for the lift tab. This causes the lift tab to be pulled radially outwardly for exposure prior to the breaking of the web 201 which then leaves the lift tab as shown in solid lines in FIG. 14. The cross section of plastic at the portion 216 is thickened so that it does not tear and this assures that the web 201 fractures. Thus, to remove the closure, one lifts up on the lift tab 267 which was formed at terminal portion of the tear strip 250 during the removal of the remainder of the tear strip 250 from the closure.

Figure 15:
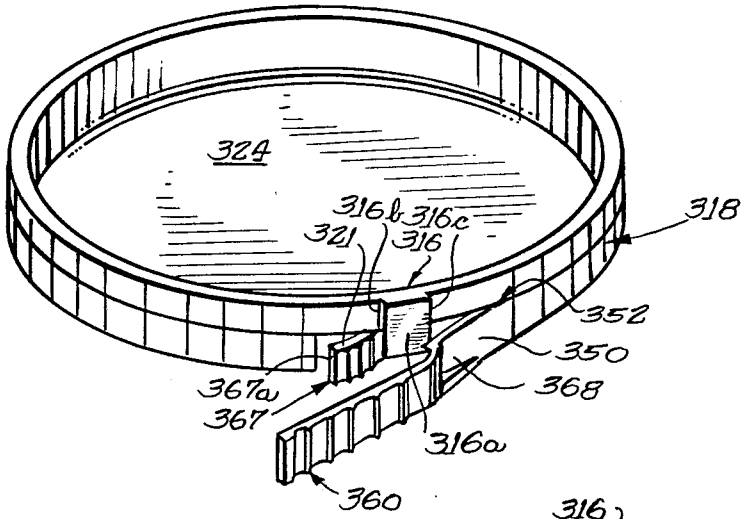
FIG. 15 illustrates a preferred embodiment of the invention.

The preferred embodiment of the invention is illustrated in FIGS. 15–20 and a prefix character "3" has been added to the reference characters used to describe similar elements in the earlier described embodiments of the invention. Hence, a complete description of similar elements described in the earlier embodiment need not be repeated hereafter. Referring to FIG. 15 the preferred and illustrated closure comprises a top panel 324 and the encircling outer skirt 318 which integrally attached thereto. A locking means 328 such as the groove and the bead on the container lock the closure to the container. The illustrated pull-tab 360 has a first bridge 365 (FIG. 17) which is connected at one end to the skirt 318. The first bridge fractures upon pulling the pull tab 360 radially outwardly, and then a second frangible means in the form of a second frangible bridge 366 pulls the lift tab 367 radially outwardly into view and to be accessible for grasping. The upper portion of the lift tab has an upper top end wall 321 which separates from the skirt wall. Thus, there is formed the outwardly projecting portion of the lift tab which the user will readily see and grasp to remove the closure of FIG. 15. Further pulling on the pull tab tears the tear strip 350 around the line of weakness 352 to remove the entire lower portion of the tear strip.

A problem with some of the afore-mentioned embodiments of the invention, such as in FIG. 7 was that the thicken portion 116 was inadequate in some instances to prevent the tearing off of the lift tab by the pull tab because the second bridge 366 would not fracture. That is, in some instances the thickened portion 116 (FIG. 7) was not sufficiently strong to cause a fracturing of the second bridge 366 with a result that the thickened portion 316 continued to tear along the line of weakness 352 across the thickened portion and then completely around the closure leaving no lift tab at all on the skirt. That is, the lift tab 367 occasionally was torn off with the pull tab 360 and the tear strip because the bridge therebetween did not fracture. Of course, what was wanted, was for the pull tab to pull the lift tab radially outwardly and to leave it exposed for ready grasping and then for the bridge 366 to break thereby leaving the lift tab attached to the skirt and detached from the pull tab.

Figure 16:
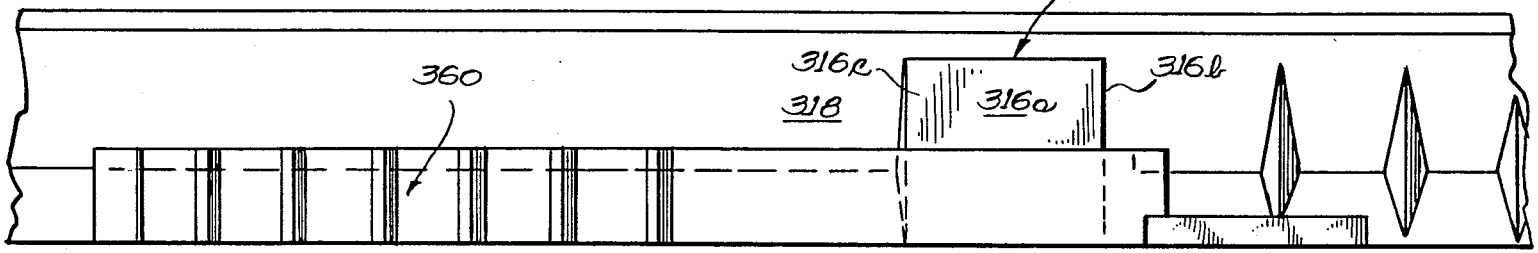
FIG. 16 illustrates an enlarged elevational view of the pull tab and lift-off tab of FIG. 15.

Experiments were run to increase the thickness and circumferential extent of the thicker cross section portion 316 but these efforts still did result in a consistent fracturing of the second bridge 366 and a leaving of the lift tab 367 attached to the skirt after removal of the tear strip. As best seen in FIGS. 15 and 16, the thickened portion 316 appears as a thickened block having an outer vertical surface **316*a* defined between vertical edges 316*b* and 316*c*. The thickened portion extends vertically from the lower tear-off strip 350 area into the upper portion of the skirt 318**. That is, the increased thickness and widths still did not overcome the problem of an occasional failure of separation between the pull tab and the lift tab thereby leaving no pull tab on the closure to aid in the closure removal from the container.

In accordance with the present invention, there is provided a new and improved construction in which the pull tab 360 consistently separates and leaves behind the lift tab 367 after it pulls the lift tab outwardly to be noticed and to be accessible. This is achieved in the preferred embodiment of the invention by adding additional cross sectional thickness of plastic within the groove or recess 336 to thicken the line of weakness 352 at the spot at which the lift tab portion 367 joins the thickened cross section lift tab portion 316.

Figure 17:
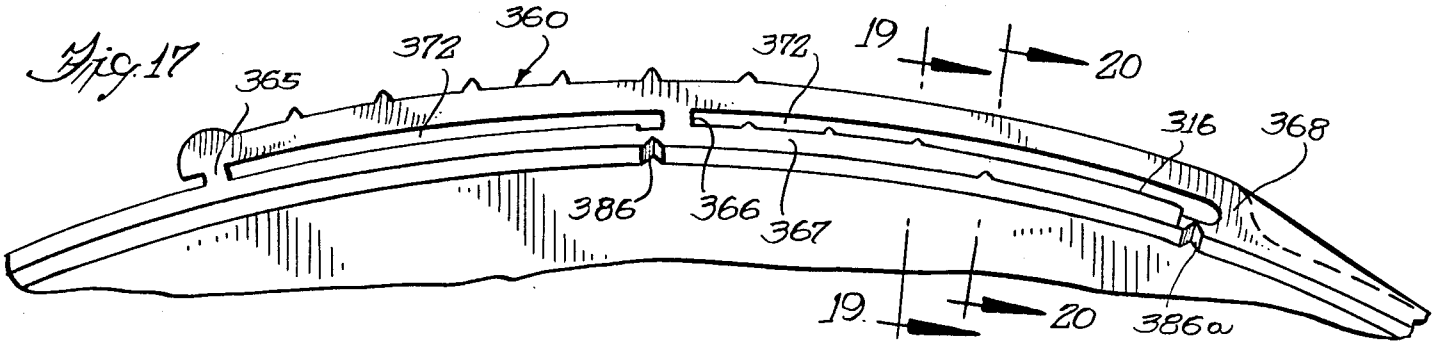
FIG. 17 is a perspective view of a portion of the tear strip, the pull tab and lift-off tab of FIG. 15 prior to closure removal.
Figure 18:
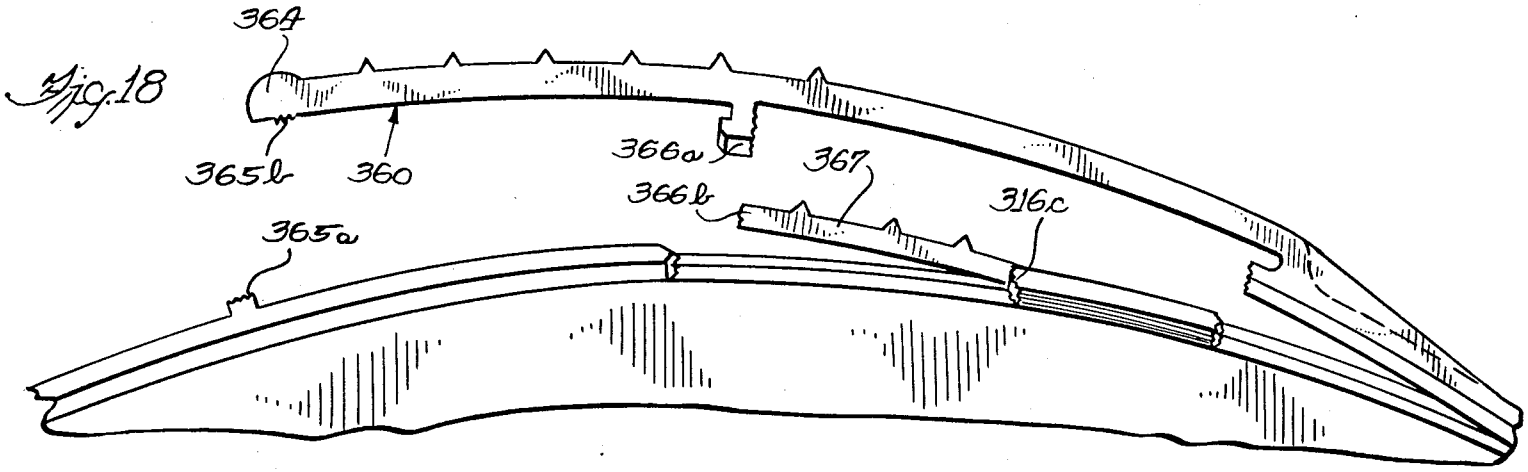
FIG. 18 is a view similar to FIG. 17 with the pull tab partially separated by the lift-off tab.
Figure 19:
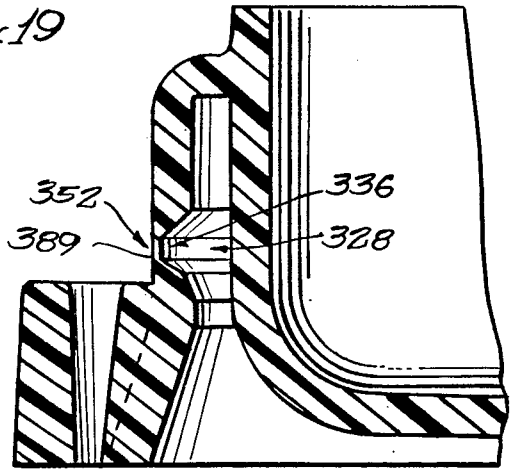
FIG. 19 is a cross sectional view taken along the line 19—19 of FIG. 17.
Figure 20:
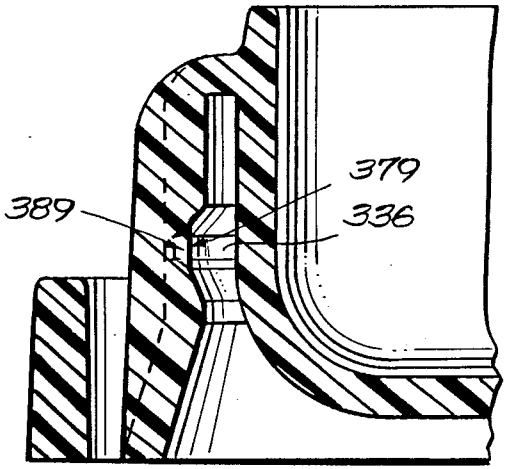
FIG. 20 is a cross sectional view taken along the line 20—20 of FIG. 17.

More specifically, as best seen in FIG. 20, the additional cross sectional material 379 has been added into the groove 336 so that the web 389 (FIG. 20) is substantially thicker, for example, an additional 0.010 inch thicker than the web 389 (FIG. 19) for the remainder of the groove 336. The circumferential extent of the thickened portion 379 is very limited, for example, about 1/16th of an inch so that it is barely noticeable to the eye and does not form a very long discontinuity in the groove 336. Herein, the additional plastic material 379 in the groove 336 begins at the vertical side **316*b* of the thickened porton and extends for 1/16th of an inch to the right as viewed in FIGS. 17 and 18. Thus, it will be seen from the foregoing that in the embodiment of the invention shown FIGS. 15–20 that the person desiring to remove the closure will grasp the knob or free end 364 and pull on the pull tab 360 to fracture the first frangible bridge 365 leaving a small portion 365*a* attached to the ring and another small portion 365*b* attached to the outer knob or free-end 364. The first or removed portion of the pull tab is spaced by the space 372 from the skirt 318 and is joined to the skirt at the second bridge 366 which is about mid-way in the length of the pull tab. The bridge 366 extends from the inner vertical sidewall of the pull tab to the outer facing side of the lift tab 367 at what will be the outer free end of the lift tab. The continued pull of the pull tab 360 causes an immediate tearing on the lift tab 367 with the separation being at the first reduced notch thickness area 386 as best seen in FIG. 17 to form a vertical free end wall 367*a* (FIG. 15). The tearing of the lift-off tab is at the line of weakness 352 with the thin cross sectional web 389 being torn easily and forming the top wall 321 on the lift tab as best seen in FIG. 15. Because the lift tab is being swung outwardly by the pull tab, it assumes a position where it can be easily seen and understood to be a lift tab for removal of the closure from the container. A continued severing along the line of weakness 352 at the thin web 389 continues until the tear reaches the thickened cross material 379 (FIG. 20), as best seen in FIG. 20, which substantially fills the groove 336. This thickened portion extends for about 1/16th of an inch circumferentially in the groove and is at the vertical edge 316*b* of the reinforced thickened portion 316 and prevents any further tearing at this juncture along the line of weakness 352. Because of this thickened wall thickness and its resistance to tearing, the second bridge 366 then fractures to leave a portion 366*a* on the pull tab and a portion 336*b* on the lift tab with a continued pull on th pull tab. At the pull tab hinge area the small web or notch 386*a* (FIG. 17) is provided to detach the hinge area 368 and thereafter the remaining lower tear-off strip 350 is readily pulled all the way around for complete removal from the skirt at the line of weakness 352. This leaves just the small lift tab 367 attached by the thickened portion 316 to the upper portion of the skirt 318 with the tear-off strip 350 having been substantially completely removed. The thickened web 389 is at the vertical hinge line located at the vertical wall 316*b* between the lift tab and the thickened portion 319** thereby providing a good strong connection for the lift tab so that the same may be used repetitively without breaking off for a number of removals of the closure from the container.

Thus, it will be seen that the closure may be molded in one piece at a high production rate and may be stacked in stacks for automatic handling by a capping machine. The containers are preferably one piece, molded plastic containers with the bead molded thereon. Manifestly, the shape of the bead may be changed from that illustrated. The preferred pull tabs are connected by a small frangible bridge to the closure skirt to prevent interlocking of the pull tabs one with another which can occur when conventional closures are formed with unconnected pull tabs and are packed in bulk containers in a helter-skelter manner.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A closure for a container having a retention bead comprising:

a one-piece plastic body having a top panel;

an encircling skirt depending from the top panel and integrally attached thereto;

a locking means on the skirt for interlocking with said retention bead to retain the closure on the container;

a removable tear strip on the lower portion of the skirt for removal to indicate that the closure has been opened;

a pull tab integral with the tear strip and located at one end thereof for grasping to tear the tear strip from the skirt;

means providing a line of weakness in the skirt and defining a breakable connection between the lower tear strip and an upper portion of the skirt;

a lift tab connected to the upper portion of the skirt for facilitating removal of the closure after the tear strip has been torn at the line of weakness;

a frangible bridge means interconnecting the pull tab and the lift tab for pulling the lift tab into a more accessible position during the removal of the tear strip, and means providing an increased cross sectional thickness portion between said lift tab and skirt to prevent the detaching of the lift tab completely from the skirt and assuring a fracturing of the bridge means.

2. A closure in accordance with claim 1 in which the locking means comprises a peripheral groove in the skirt and the means providing the increased cross sectional thickness portion comprises material filling in a portion of the peripheral groove.

3. A closure in accordance with claim 2 in which said lift tab is located at the removal tear strip and a top side of the lift tab is connected to said skirt at said line of weakness, the outward pulling of the lift tab by the pull tab breaking the line of weakness and thereby allowing the lift tab to be pulled radially outwardly from the skirt wall.

4. A closure in accordance with claim 1 in which a depending portion is attached to the upper portion of the skirt after removal of the tear strip, and the outwardly extending lift tab is hinged to the depending portion along a vertical hinge axis.

5. A closure in accordance with claim 4 in which the depending portion has a greater cross sectional thickness than the outwardly extending portion of the lift tab.

6. A closure in accordance with claim 1 in which said lift tab is hingedly connected to the skirt at a substantially vertical hinge axis, the lift tab being swung radially outwardly from the skirt about the vertical hinge axis.

7. A closure for a container having a retention bead comprising:

a top panel;

a depending skirt extending about periphery of the top panel and extending downwardly from said top panel;

a locking means on the skirt for engaging the retention bead on the container to hold the closure on the container;

a removable tear strip on the lower portion of the skirt having a line of weakness connection with an upper portion of the skirt;

a pull tab for the removable tear strip molded integrally with the tear strip to be pulled to tear the tear strip at the line of weakness to detach the tear strip from the skirt;

a lift tab connected to the skirt and hinged about an axis to be bent outwardly from the skirt to be accessible to lift the closure from the container, and means extending from the pull tab to the lift tab to pull the lift tab to its outward accessible position with pulling of the pull tab and tear strip from the skirt.

8. A closure in accordance with claim 7 in which the hinge axis for the lift tab is disposed substantially vertically.

9. A closure in accordance with claim 7 in which the pull tab is spaced from the skirt by a slot and in which the means extending from the pull tab to the lift tab comprises a frangible bridge which fractures after the lift tab has been pulled outwardly from the skirt.

* * * * *